US008451206B2

(12) United States Patent
Tanaka et al.

(10) Patent No.: US 8,451,206 B2
(45) Date of Patent: May 28, 2013

(54) LIQUID CRYSTAL DISPLAY AND METHOD WITH FIELD SEQUENTIAL DRIVING AND FRAME POLARITY REVERSAL

(75) Inventors: Yukio Tanaka, Kanazawa (JP); Kenji Nakao, Kanazawa (JP); Tetsuo Fukami, Ishikawa-gun (JP)

(73) Assignee: Japan Display Central Inc., Fukaya-shi (JP)

( * ) Notice: Subject to any disclaimer, the term of this patent is extended or adjusted under 35 U.S.C. 154(b) by 978 days.

(21) Appl. No.: 11/850,430

(22) Filed: Sep. 5, 2007

(65) Prior Publication Data

US 2008/0074568 A1 Mar. 27, 2008

(30) Foreign Application Priority Data

Sep. 26, 2006 (JP) ..... 2006-261076

(51) Int. Cl.
*G09G 3/36* (2006.01)

(52) U.S. Cl.
CPC ..... *G09G 3/3614* (2013.01)
USPC ..... 345/96

(58) Field of Classification Search
USPC ..... 345/87–96, 99–104, 204–209, 54
See application file for complete search history.

(56) References Cited

U.S. PATENT DOCUMENTS

| | | | | |
|---|---|---|---|---|
| 6,552,704 | B1 * | 4/2003 | Zavracky et al. | 345/88 |
| 6,590,553 | B1 * | 7/2003 | Kimura et al. | 345/92 |
| 7,145,536 | B1 * | 12/2006 | Yamazaki et al. | 345/89 |
| 7,161,574 | B2 | 1/2007 | Kimura et al. | |
| 2002/0003704 | A1 * | 1/2002 | Ohmae et al. | 362/293 |
| 2002/0196220 | A1 * | 12/2002 | Sato et al. | 345/87 |
| 2003/0058229 | A1 * | 3/2003 | Kawabe et al. | 345/204 |
| 2004/0246216 | A1 * | 12/2004 | Hosaka | 345/87 |
| 2005/0052388 | A1 * | 3/2005 | Handschy et al. | 345/89 |
| 2005/0083287 | A1 * | 4/2005 | Yamazaki et al. | 345/92 |

FOREIGN PATENT DOCUMENTS

| | | |
|---|---|---|
| JP | 5-80717 | 4/1993 |
| JP | 2003-287733 | 10/2003 |
| JP | 2006-171084 | 6/2006 |

OTHER PUBLICATIONS

U.S. Appl. No. 12/114,208, filed May 2, 2008, Fukami, et al.
U.S. Appl. No. 12/771,191, filed Apr. 30, 2010, Tanaka, et al.
U.S. Appl. No. 12/877,551, filed Sep. 8, 2010, Tanaka, et al.
U.S. Appl. No. 13/220,960, filed Aug. 30, 2011, Nakao, et al.

* cited by examiner

*Primary Examiner* — Liliana Cerullo
(74) *Attorney, Agent, or Firm* — Oblon, Spivak, McClelland, Maier & Neustadt, L.L.P.

(57) ABSTRACT

A liquid crystal display device includes a liquid crystal display panel (LCD panel), an area light source device which illuminates the LCD panel, a driving unit which drives the LCD panel and the area light source device, and a control unit which controls the driving unit. The LCD panel includes display pixels. The area light source device includes plural kinds of light sources which are successively turned on in one frame period. The control unit includes means for controlling the driving unit in a manner to execute video signal write and reset signal write after the video signal write, in a period in which one of the plural kinds of light sources is turned on in the one frame period. The video signal write and the reset signal write are executed with the same polarity, and a polarity of potential of the display pixels is reversed between frame periods.

9 Claims, 5 Drawing Sheets

LIQUID CRYSTAL DISPLAY AND METHOD WITH FIELD SEQUENTIAL DRIVING AND FRAME POLARITY REVERSAL

CROSS-REFERENCE TO RELATED APPLICATIONS

This application is based upon and claims the benefit of priority from prior Japanese Patent Application No. 2006-261076, filed Sep. 26, 2006, the entire contents of which are incorporated herein by reference.

BACKGROUND OF THE INVENTION

1. Field of the Invention

The present invention relates generally to a liquid crystal display device and a method of driving the same, and more particularly to an active-matrix liquid crystal display device and a method of driving the same.

2. Description of the Related Art

In recent years, mobile products in which liquid crystal panels are built, such as small-sized game machines, portable PCs and mobile phones, have been quickly gaining in popularity.

In general, the liquid crystal display panel is configured such that a liquid crystal layer is held between an array substrate and a counter-substrate. In the case where the liquid crystal display panel is of an active matrix type, the array substrate includes a plurality of pixel electrodes which are arranged substantially in a matrix, a plurality of gate lines which are disposed along rows of the plural pixel electrodes, a plurality of source lines which are disposed along columns of the plural pixel electrodes, and a plurality of pixel switching elements which are disposed near intersections of the plural gate lines and plural source lines.

The respective gate lines are connected to a gate driver which drives the gate lines. The respective source lines are connected to a source driver which drives the source lines. The gate driver and source driver are controlled by a control circuit.

Each of the switching elements is composed of, e.g. a thin-film transistor (TFT). When the associated gate line is driven by the gate driver, the switching element is rendered conductive, thereby applying a pixel voltage, which is set on the associated source line by the source driver, to the associated pixel electrode. The counter-substrate is provided with a common electrode which is opposed to the plural pixel electrodes disposed on the array substrate.

A liquid crystal pixel is constituted by a pair of each pixel electrode and the common electrode, together with a pixel region which is a part of the liquid crystal layer that is interposed between these paired electrodes. A driving voltage for the pixel is a difference between a pixel voltage, which is applied to the pixel electrode, and a counter-voltage which is applied to the common electrode. Even after the switching element is turned off, the driving voltage is retained between the pixel electrode and the common electrode.

Alignment of liquid crystal molecules in the pixel region is set by an electric field which corresponds to the driving voltage. Thereby, the transmittance of the pixel is controlled. The polarity inversion of the driving voltage is executed, for example, by cyclically reversing the polarity of the pixel voltage relative to the counter-voltage. Thus, the direction of electric field is reversed to prevent non-uniform distribution of liquid crystal molecules in the liquid crystal layer.

Attention has been paid to a field sequential method as a driving method of a liquid crystal panel. In the field sequential method, a color image is divided into, for example, an R (red) component, a G (green) component and a B (blue) component, and the respective components are sequentially displayed on the display panel in a time-division manner.

The field sequential method is characterized in that the light use efficiency is higher than in an ordinary color filter method. In the ordinary color filter method, since white backlight passes through RGB color filters, a loss occurs in light use efficiency. By contrast, since the field sequential method requires no color filter, no loss occurs, in principle, in the light use efficiency.

Moreover, in the field sequential method, there is no need to divide one pixel into sub-pixels of RGB, as in the color filter method. Thus, since the pixel aperture ratio can be made higher than in the color filter method, the occurrence of loss of light use efficiency can advantageously be suppressed. In the prior art, there has been proposed a liquid crystal display device which performs color liquid crystal display on a transmissive liquid crystal display panel that is of a normally black-and-white mode (see Jpn. Pat. Appln. KOKAI Publication No. 5-80717).

In a liquid crystal display device which adopts the field sequential method, in a case where column inversion or frame inversion is executed as a polarity inversion scheme, image quality may deteriorate, in some cases, due to a luminance gradient occurring in a display image.

BRIEF SUMMARY OF THE INVENTION

The present invention has been made in consideration of the above-described problems, and the object of the invention is to provide a liquid crystal display device and a driving method thereof, to which column inversion or frame inversion, in particular, frame inversion, is applied as a polarity inversion scheme, and which can prevent occurrence of a luminance gradient in a display image when a field sequential driving method is adopted, thus suppressing degradation in image quality.

According to a first aspect of the present invention, there is provided a liquid crystal display device comprising: a liquid crystal display panel including a pair of substrates and a liquid crystal layer held between the pair of substrates; an area light source device which illuminates the liquid crystal display panel; a driving unit which drives the liquid crystal display panel and the area light source device; and a control unit which controls the driving unit, wherein the liquid crystal display panel includes a plurality of display pixels which are arrayed in a matrix, the area light source device includes plural kinds of light sources which are successively turned on in one frame period, the control unit includes means for controlling the driving unit in a manner to execute video signal write for writing a video signal in the plurality of display pixels and reset signal write for writing a reset signal in the plurality of display pixels after the video signal write, in a period in which one of the plural kinds of light sources is turned on in the one frame period, and the video signal write and the reset signal write are executed with the same polarity, and a polarity of potential of the plurality of display pixels is reversed between frame periods.

According to a second aspect of the present invention, there is provided a driving method of a liquid crystal display device including a liquid crystal display panel including a pair of substrates and a liquid crystal layer held between the pair of substrates; an area light source device which illuminates the liquid crystal display panel; a driving unit which drives the liquid crystal display panel and the area light source device; and a control unit which controls the driving unit, the liquid crystal display panel including a plurality of display pixels which are arrayed in a matrix, the method comprising: causing the control unit to successively turn on plural kinds of light sources, which are provided in the area light source device, in one frame period; controlling the driving unit to execute, with the same polarity, video signal write for writing a video signal in the plurality of display pixels and reset signal write for writing a reset signal in the plurality of display pixels after the video signal write, in a period in which one of the plural kinds of light sources is turned on in the one frame period; and reversing a polarity of potential of the plurality of display pixels between frame periods.

The invention can provide a liquid crystal display device and a driving method thereof, to which column inversion or frame inversion, in particular, frame inversion, is applied as a polarity inversion scheme, and which can prevent occurrence of a luminance gradient in a display image when a field sequential driving method is adopted, thus suppressing degradation in image quality.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
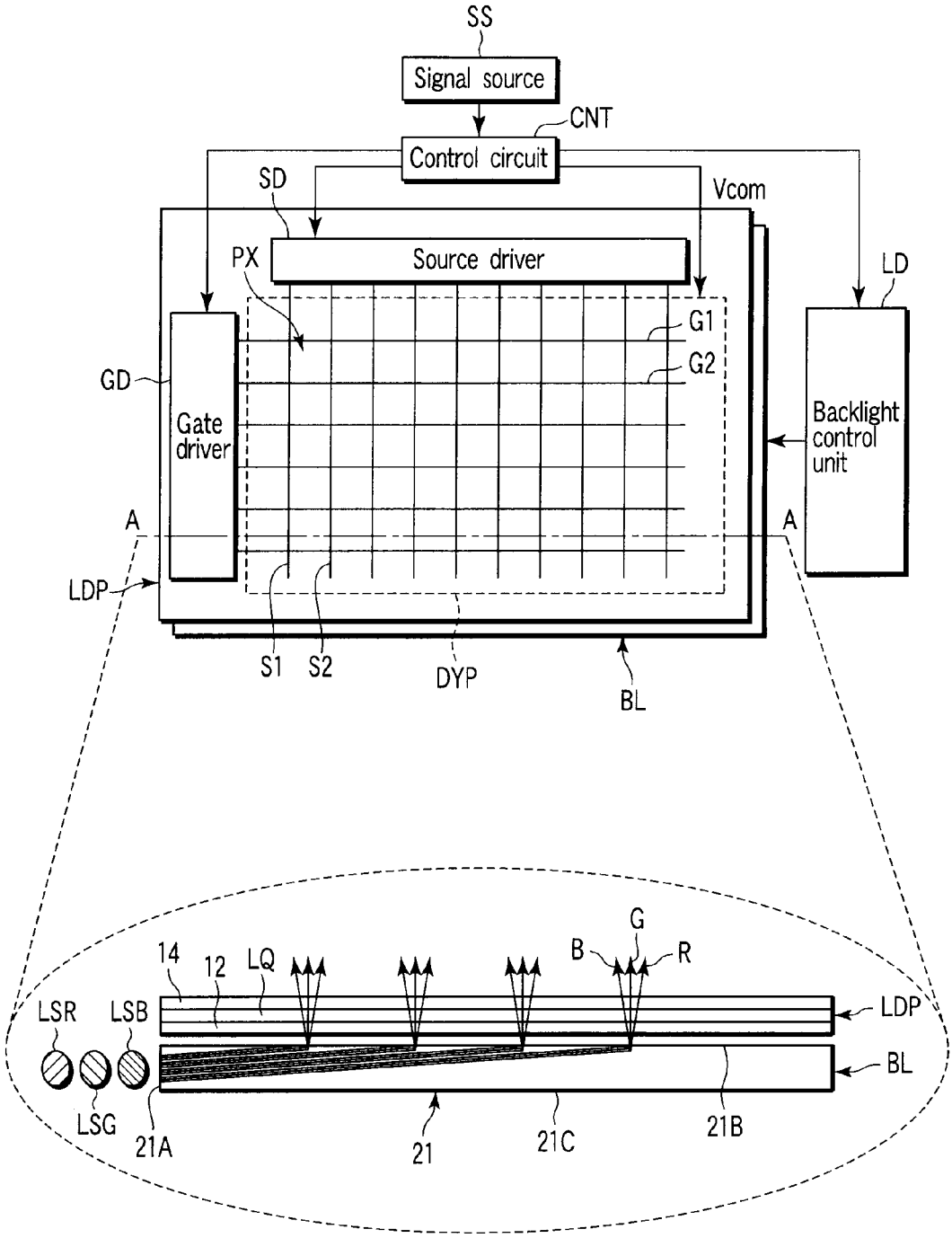
FIG. 1 schematically shows an example of the structure of a liquid crystal display device according to an embodiment of the present invention.

A liquid crystal display device according to a first embodiment of the present invention will now be described with reference to the accompanying drawings. FIG. 1 schematically shows an example of the structure of a liquid crystal display device according to the embodiment. FIG. 1 contains a plan view of the liquid crystal display device, and a cross-sectional view taken along line A-A in the plan view. As is shown in FIG. 1, the liquid crystal display device according to the embodiment includes a liquid crystal display panel LDP and a backlight BL which illuminates the liquid crystal display panel LDP.

The liquid crystal display panel LDP includes a pair of substrates, i.e. an array substrate 12 and a counter-substrate 14, and a liquid crystal layer LQ which is held between the array substrate 12 and the counter-substrate 14. In the liquid crystal display device according to the embodiment, the liquid crystal layer LQ includes an OCB (Optically Compensated Bend) liquid crystal.

Further, the liquid crystal display panel LDP includes a display section DYP which is composed of a plurality of display pixels PX that are arrayed in a matrix. In the display section DYP, a plurality of source lines SL (SL1 to SLn), which are arranged along the columns of the display pixels PX, and a plurality of gate lines GL (GL1 to GLm), which are arranged along the rows of the display pixels PX, are disposed.

The plural source lines SL and plural gate lines GL are connected to a source driver SD and a gate driver GD, respectively, which function as a driving unit for driving the liquid crystal display panel LDP. The source driver SD and gate driver GD are controlled by a control circuit CNT. The control circuit CNT controls the source driver and gate driver by, e.g. a video signal and a timing signal which are input from an external signal source SS.

Specifically, the gate driver GD is connected to the plural gate lines GL and successively drives the plural gate lines GL in accordance with a control signal from the control circuit CNT. The source driver SD is connected to the plural source lines SL and successively drives the plural source lines SL in accordance with a control signal from the control circuit CNT.

Figure 2:
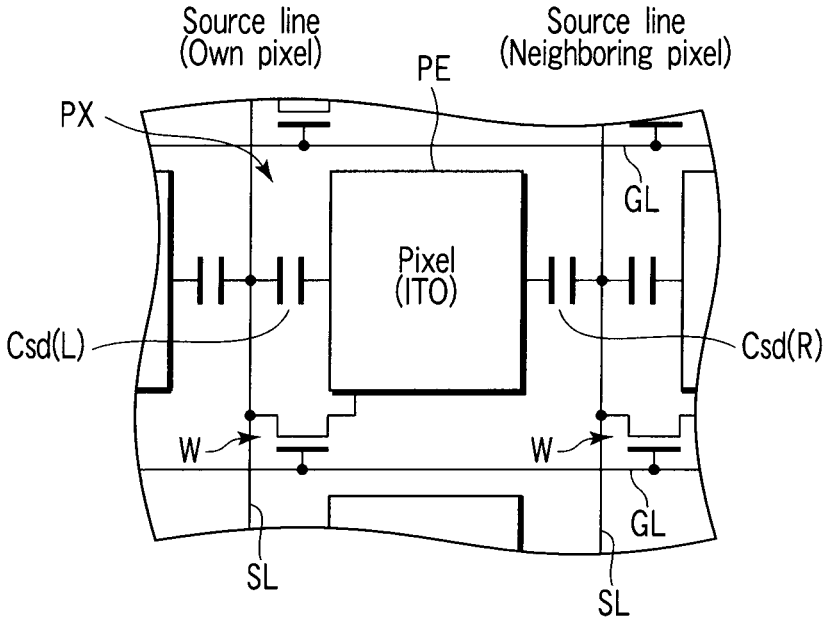
FIG. 2 schematically shows an example of the structure of a display pixel of the liquid crystal display device shown in FIG. 1.

In each of the display pixels PX of the liquid crystal display panel LDP, the array substrate 12 includes a pixel electrode PE and a pixel switch W, as shown in FIG. 2. The pixel switch W is, for instance, a thin-film transistor (TFT).

The gate electrode of the pixel switch W is connected to the associated gate line GL (or formed integral with the associated gate line GL). The source electrode of the pixel switch W is connected to the associated source line SL (or formed integral with the associated source line SL). The drain electrode of the pixel switch W is connected to the associated pixel electrode PE.

The counter-substrate 14 includes a counter-electrode (not shown) which is disposed to be opposed to the plural pixel electrodes PE. A counter-voltage Vcom is applied from the control circuit CNT to the counter-electrode. Thereby, a pixel capacitance is formed between each pixel electrode PE and the counter-electrode.

As shown in FIG. 1, the backlight BL is disposed on the back side of the liquid crystal display panel LDP. The backlight BL includes a light source LS and a light guide 21 having a light incidence surface 21A that faces the light source LS.

The light source LS includes color light sources LSR, LSG and LSB (e.g. LED light sources) of three colors, i.e. red (R), green (G) and blue (B). The light guide 21 also has a light emission surface 21B which emits incident light from the light incidence surface 21A toward the liquid crystal display panel LDP, and a counter-surface 21C which is opposed to the light emission surface 21B.

The backlight BL further includes a reflection sheet which is disposed on the counter-surface 21C side of the light guide 21, and an optical sheet (not shown), such as a diffusion sheet, which is disposed on the light emission surface 21B side.

The light source LS of the backlight BL is driven by a backlight control unit LD. Specifically, the control circuit CNT controls the turn-on timing of each color light source LSR, LSG, LSB via the backlight control unit LD that is a driving unit of the backlight BL.

Figure 3:
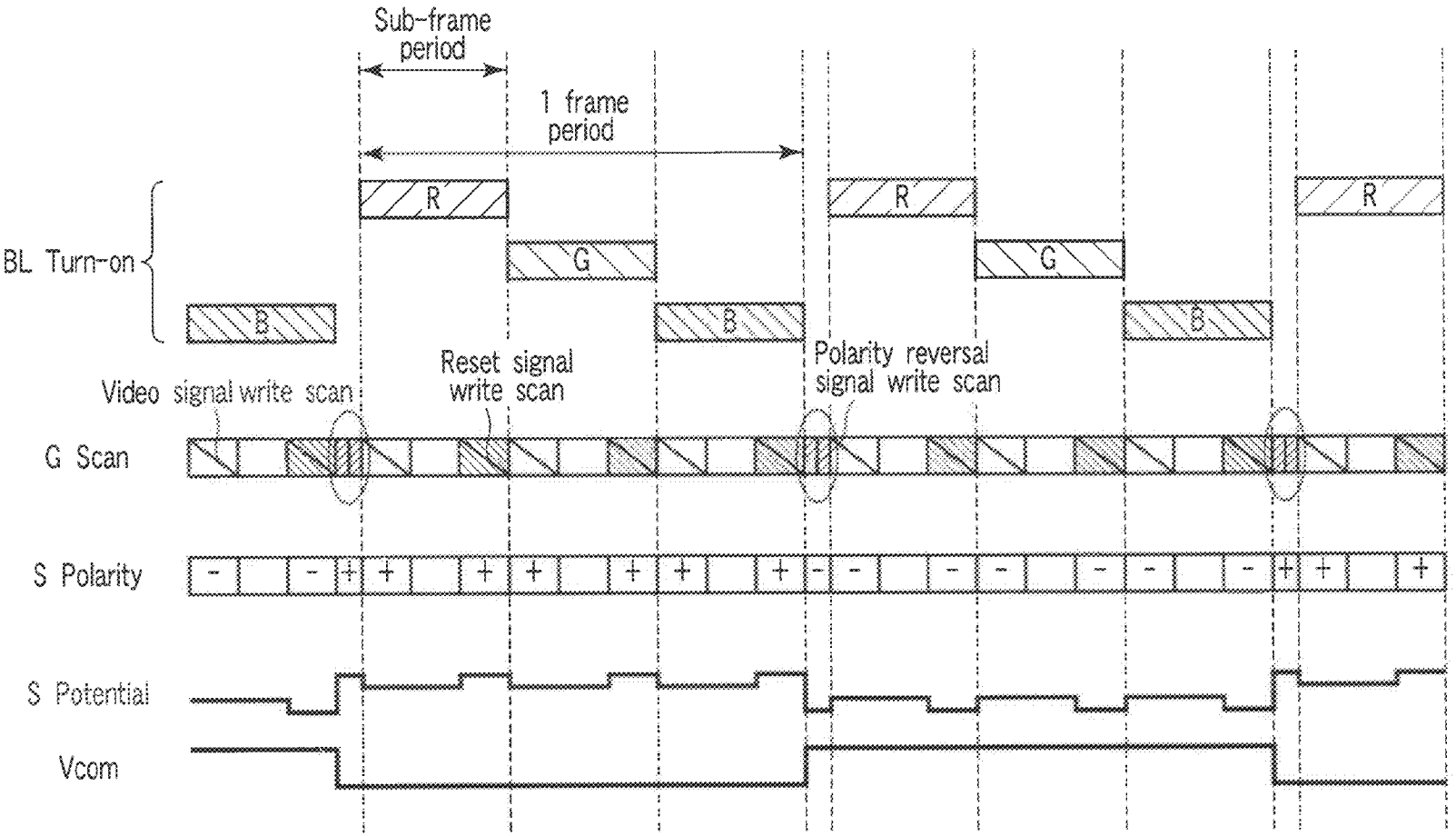
FIG. 3 is a view for explaining an example of a driving method of the liquid crystal display device shown in FIG. 1.

In the liquid crystal display device according to the present embodiment, as shown in FIG. 3, one frame period is divided into three sub-frame periods. Further, each of the sub-frame periods includes a video signal write period for successively writing a video signal in the plural display pixels PX, a hold period for holding the written video signal, and a reset signal write period in which the driving unit successively writes a reset signal in the plural display pixels PX.

In the liquid crystal display device according to the present embodiment, the polarity of the video signal and reset signal that are applied to the source line SL is reversed on a frame-by-frame basis, as shown in FIG. 3. Specifically, in each sub-frame period, the video signal write and the reset signal write are executed with the same polarity. The polarity of the potential of the display pixel PX is reversed between neighboring frame periods.

In the case of the liquid crystal display device according to the present embodiment, as shown in FIG. 3, the source driver SD and gate driver GD batch-write a polarity inversion signal in the plural display pixels PX between the neighboring frame periods. At this time, the polarity of the polarity inversion signal is opposite to the polarity of the reset signal in the preceding frame period.

Specifically, in a period between a blue sub-frame period and a red sub-frame period of a subsequent frame period, the gate driver GD drives all gate lines GL batchwise, and the source driver SD applies a black display signal as a polarity inversion signal to the source lines SL.

In the liquid crystal display device according to the present embodiment, as described above, the polarity of potential in the display pixels PX is the same in one frame period, and the polarity of potential of the display pixels PX is reversed only when the polarity inversion signal is batch-written between frame periods.

In the meantime, as polarity inversion schemes for the liquid crystal display device, there are known, for instance, dot inversion, line inversion, column inversion and frame inversion (field inversion). From the standpoint of image quality, the dot inversion is most excellent by virtue of a low degree of flicker, crosstalk or luminance gradient.

On the other hand, from the standpoint of power consumption, the dot inversion and line inversion require high power consumption since the inversion of polarity of a source line potential is necessary in every horizontal cycle and electric charge/discharge has to be executed for this purpose. By contrast, the column inversion and frame inversion require low power consumption since the source line polarity is the same through one field.

In general, the polarity inversion scheme is selected depending on the purpose of use. In particular, in the case of the use for mobile equipment, the reduction in power consumption in circuitry is necessary because of long-time use by batteries. Hence, it is desirable to select the column inversion or frame inversion.

Next, a description is given of the driving method of the liquid crystal display device according to the present embodiment. In the liquid crystal display device according to this embodiment, the control circuit CNT drives the liquid crystal display panel LDP and backlight BL, as shown in FIG. 3.

Specifically, the control circuit CNT divides one display cycle (one frame period) into three sub-frame periods. At this time, the control circuit CNT controls the turn-on timing so that any one of the red light source LSR, green light source LSG and blue light source LSB emits light in the associated sub-frame period.

For example, in the case shown in FIG. 3, the control circuit CNT turns on the red light source LSR in the first sub-frame period, turns on the green light source LSG in the next sub-frame period, and turns on the blue light source LSB in the last sub-frame period.

On the other hand, the control circuit CNT controls the driving timing of the liquid crystal display panel LDP in the following manner. Specifically, the control circuit CNT causes the source driver SD and the gate driver GD to execute signal write scan (video signal write) in a video signal write period within one sub-frame period, to execute hold (signal hold) in a hold period within the sub-frame period, and to execute reset signal write scan (black insertion scan) for writing a black display signal as a reset signal in a reset signal write period within the sub-frame period.

Specifically, the source driver SD and gate driver GD successively write a video signal, which corresponds to red display, in a plurality of display pixels PX in the video signal write period of the first sub-frame period. Then, the source driver SD and gate driver GD write a voltage signal (black display signal), which corresponds to black display, as a reset signal in the display pixels PX in the reset signal write period.

At this time, the backlight BL is controlled by the backlight control unit LD so as to turn on the red light source LSR. Thus, in the first sub-frame period, a red image is displayed on the display DYP.

In the next sub-frame period, the source driver SD and gate driver GD successively write a video signal in a plurality of display pixels PX in the video signal write period. Then, the source driver SD and gate driver GD write a black display signal as a reset signal in the display pixels PX in the reset signal write period.

At this time, the backlight BL is controlled by the backlight control unit LD so as to turn on the green light source LSG. Thus, in this sub-frame period, a green image is displayed on the display DYP.

In the last sub-frame period, the source driver SD and gate driver GD successively write a video signal in a plurality of display pixels PX in the video signal write period. Then, the source driver SD and gate driver GD write a black display signal as a reset signal in the display pixels PX in the reset signal write period.

At this time, the backlight BL is controlled by the backlight control unit LD so as to turn on the blue light source LSB. Thus, in this last sub-frame period, a blue image is displayed on the display DYP.

As described above, the liquid crystal display device according to the embodiment is a field sequential type liquid crystal display device.

The following is the reason why the reset signal write is executed after the video signal write is executed in each sub-frame period.

In an area of the screen in which the scanning timing is late (e.g. a lower-end area when the screen is scanned from the upper side to the lower side), until signal write scan is executed in, e.g. a sub-frame for green display, a signal of an immediately preceding sub-frame for red display is retained in the panel. In this case, there occurs a time period in which the backlight emits light of the green light source, despite the liquid crystal display panel being in the state in which red display is executed. As a result, a desired color image cannot be obtained.

This problem may be avoided by setting such a timing that the backlight is turned on only in the hold period. However, in this case, the turn-on duty ratio of the backlight (i.e. the radio of the time in which the backlight is turned on) decreases and the time-averaged luminance lowers. As a result, there arises another problem that an obtained image becomes dark.

In addition, owing to the dielectric anisotropy of the liquid crystal, the liquid crystal dielectric constant at a time of executing signal write, e.g. in the sub-frame for green display, varies depending on the display state in the immediately preceding sub-frame for red display. Consequently, an immediately preceding red display image remains in a display image in the hold period at the time of green display. On the other hand, if the reset signal write scan is executed, the display state of the preceding sub-frame is reset, and such an afterimage does not occur.

If the control circuit CNT writes, in the liquid crystal panel, signals of color components corresponding to an original color image in the signal write scanning periods of the respective sub-frames, the liquid crystal panel successively displays images of the respective color components. Further, if the sub-frame periods for displaying the images of the respective color components are switched at a sufficiently high speed, the original color image, in which these color components are integrated, is recognized by the human eye.

Specifically, when the liquid crystal display device is driven by adopting the field sequential method, as described above, it is necessary to switch the image quickly in every sub-frame. To achieve this, the liquid crystal display device according to the present embodiment adopts an OCB (Optically Compensated Bend) mode as a liquid crystal mode that is suited to high responsivity.

When the OCB mode is adopted, a display operation is executed by transitioning in advance the alignment state of liquid crystal molecules from a splay alignment to a bend alignment. The bend alignment state of liquid crystal molecules reversely transitions to the splay alignment if a voltage-off state or a state close to the voltage-off state continues for a long time.

The reverse transition of the liquid crystal molecules is prevented by periodically applying a signal of a threshold voltage or more to the display pixels PX, regardless of a display image. In the liquid crystal display device according to this embodiment, a black display signal is periodically applied as a reset signal to the display pixels PX. Thereby, the video signal that is retained in the display pixels PX is reset, and the reverse transition of the alignment state of liquid crystal molecules is prevented.

In addition, in the liquid crystal display device according to this embodiment, a black display signal is written as a polarity inversion signal in the display pixels. Accordingly, the polarity inversion signal functions both to reverse the polarity of potential of the display pixels PX and to prevent reverse transition of liquid crystal molecules.

In the liquid crystal display device according to this embodiment, as shown in FIG. 3, the control circuit CNT controls the source driver SD and gate driver GD so as to batch-write the polarity inversion signal in the plural display pixels PX in a period between frame periods.

Specifically, in a period between the sub-frame period for blue display and the sub-frame period for red display in the subsequent frame period, the gate driver GD batch-drives all gate lines GL and the source driver SD applies, as the polarity inversion signal, the black display signal to the source lines SL, the black display signal having the polarity opposite to the polarity of the reset signal in the sub-frame for blue display.

In the liquid crystal display device according to this embodiment, as described above, the polarity in all scans in one frame period is set to be the same, and the polarity of potential of the display pixels is reversed only when the polarity inversion signal is batch-written between the frame periods. Thereby, the polarity of the signal write scan is the same as the polarity of the reset signal write scan in the sub-frame periods for red display, green display and blue display, and a luminance gradient of the display image can be eliminated.

In a conventional field sequence type liquid crystal display device which adopts a frame inversion scheme as a polarity inversion scheme, the following driving is executed.

As regards the polarity of the output voltage of the source driver SD, the control circuit CNT reverses the polarity of the voltage, which is to be applied to the liquid crystal layer LQ, in every frame cycle. The reason for this is that if the polarity of the voltage that is applied to the liquid crystal layer LQ is set to the same, a voltage of a fixed polarity is applied to the liquid crystal layer LQ for a long time. As a result, ions in the liquid crystal layer LQ are non-uniformly distributed, leading to, e.g. burn-in of a display image.

Next, as regards the polarity of the reset signal write scan and the polarity of the video signal write scan, the control circuit CNT sets the same polarity for the last reset signal write scan in a certain sub-frame and for the first video signal write scan of the next sub-frame.

If the polarity for the last reset signal write scan in a certain sub-frame is set to be opposite to the polarity for the first video signal write scan of the next sub-frame, it is necessary to charge the pixel potential from the negative (positive) black level to the positive (negative) signal level at the time of video signal write. Consequently, a longer time is needed until the pixel potential reaches a desired potential level, and write deficiency may occur, compared to the case where the same polarity is set for the last reset signal write scan in a certain sub-frame and for the first video signal write scan of the next sub-frame.

Furthermore, as described above, in the case of the field sequential method, high-speed scan needs to be executed. Specifically, since the video signal write scan and the reset signal write scan are performed within one sub-frame period, the gate line GL is scanned six times within one frame period. Thus, the scan needs to be executed at a speed that is at least six times higher than in the color filter method. Consequently, the write time for one row (i.e. the time in which the pixel switch W is turned on in order to write each signal) becomes shorter, and write deficiency tends to easily occur.

From the standpoint of write performance, it is not always necessary to set the same polarity for the first video signal write scan in a certain sub-frame and for the subsequent reset signal write scan (i.e. the last reset signal write scan in the same sub-frame), unlike the above-described case of the polarity for the last reset signal write scan in a certain sub-frame and for the video signal write scan in the subsequent sub-frame.

Specifically, in the case of the reset signal write scan, since a fixed black display signal is written from the upper part to the lower part of the screen, the output voltage of the source driver is fixed during the scan period if the column inversion driving or frame inversion driving is executed.

Thus, even in the case of the high-speed scan which is executed while the selection periods of the respective rows (i.e. the periods in which the pixel switches W are turned on) are temporally overlapped, a sufficient write time for each row can be secured.

For example, when the scan is executed while the selection periods of the respective rows are temporally overlapped, the gate driver GD simultaneously selects gate lines GL1, GL2, GL3 and GL4 in a certain horizontal cycle, simultaneously selects gate lines GL2, GL3, GL4 and GL5 in the next horizontal cycle, and simultaneously selects gate lines GL3, GL4, GL5 and GL6 in the next horizontal cycle.

In the case of the video signal write scan, the output voltage of the source driver varies in every horizontal cycle. Thus, if the above-described overlap scan is executed, the pixel charge potential is affected not only by the output signal of the source driver in a current horizontal cycle but also by the output signal in an immediately preceding horizontal cycle. Consequently, if the overlap scan is executed at the time of the video signal write scan, such a problem arises that when an image or a character is displayed, the displayed image or character will blur. For this reason, the overlap scan cannot be adopted.

If the polarity of the output signal of the source driver SD is to be set as described above, the polarity for the first video signal write scan and the polarity for the last reset signal write scan have to be reversed in the sub-frame period of at least one of the three colors. In fact, if the same polarity is set for the video signal write and the reset signal write in the sub-frame period, the polarity of the output signal of the source driver SD cannot be set as described above, and the frame inversion scheme cannot be adopted.

Figure 5:
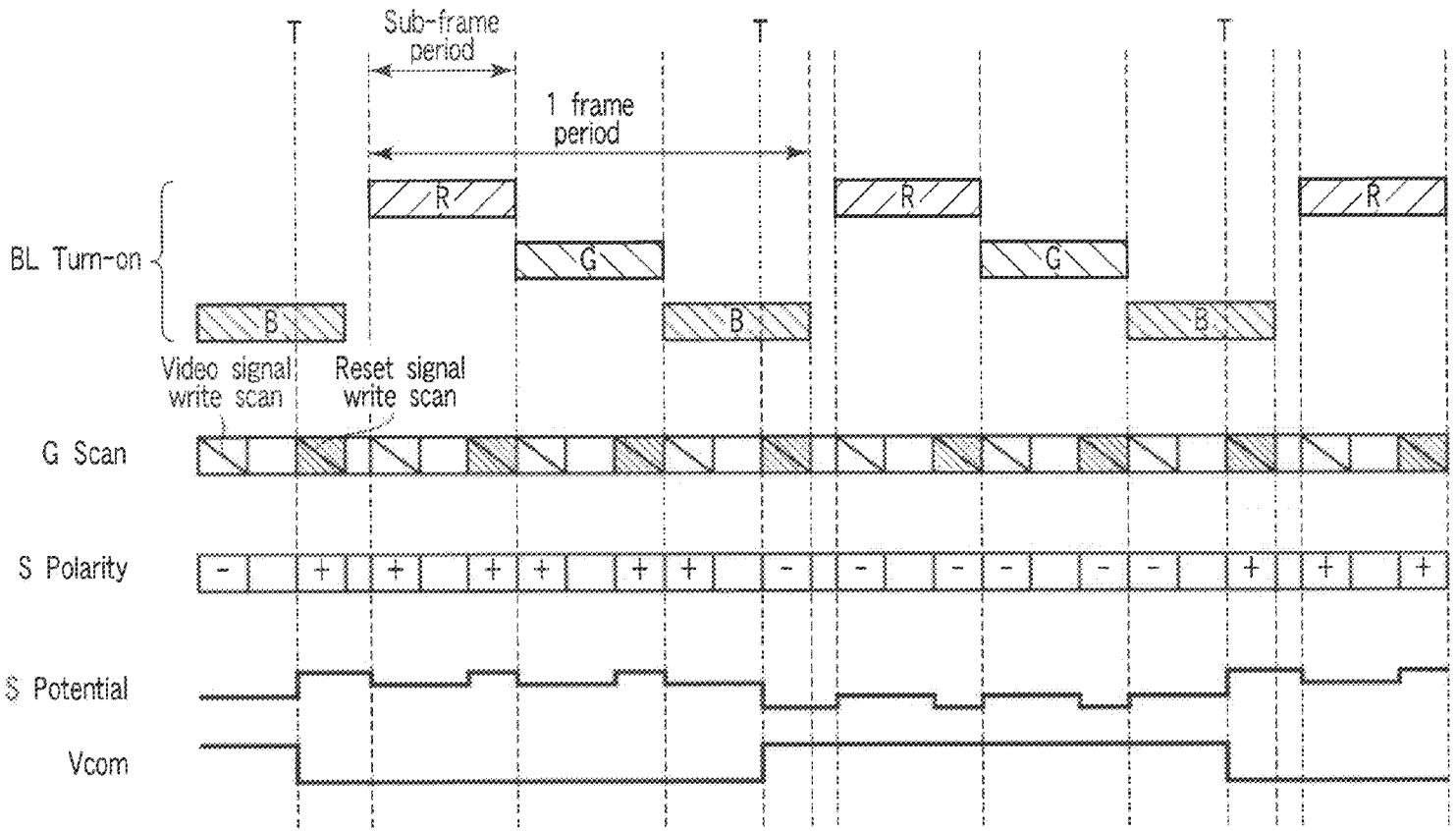
FIG. 5 (RELATED ART)
FIG. 5 is a view for explaining a driving method of a conventional liquid crystal display device.

FIG. 5 shows the case in which the polarity of the video signal write scan and the polarity of the reset signal write scan in the sub-frame period for blue display are reversed. In the case where the polarity of the video signal write scan and the polarity of the reset signal write scan in the sub-frame period are reversed, the problem with the write time can be avoided by the overlap scan, as described above.

However, as shown in FIG. 2, the pixel electrode PE has a parasitic capacitance Csd(L) between itself and a neighboring left-side source line SL, and a parasitic capacitance Csd(R) between itself and a neighboring right-side source line SL. Thus, the moment that the polarity of the output of the source driver SD is reversed, that is, at a timing T shown in FIG. 5, the pixel potential is capacitive-coupled to the parasitic capacitance Csd(L) or parasitic capacitance Csd(R) and the retained voltage shifts.

In a region of the screen where the scan timing is early, for example, in an upper-end region in a case where the screen is scanned from the upper side to the lower side, the subsequent reset signal write scan is executed immediately after the timing T, and thus the display state of the liquid crystal is hardly affected.

On the other hand, in a region of the screen where the scan timing is late, for example, in a lower-end region in a case where the screen is scanned from the upper side to the lower side, there is a length of time from the voltage shift at the timing T to the reset signal write scan. Thus, the liquid crystal responds within the time period up to the reset signal write scan, and the transmittance varies. In other words, when a specified color (blue in FIG. 5) is displayed over a region from the upper part to the lower part of the screen, a luminance gradient may occur.

In the case of adopting the column inversion scheme, since the polarity of the source line SL of the own pixel in FIG. 2 is opposite to the polarity of the source line SL of the neighboring pixel, the parasitic capacitance Csd(L) and the parasitic capacitance Csd(R) cancel each other's influence if their values are substantially equal. However, in the case of adopting the frame inversion scheme, since the polarities of both source lines SL are the same, the degree of luminance gradient becomes more conspicuous due to the influence of the parasitic capacitance Csd(L) and the parasitic capacitance Csd(R).

On the other hand, in the liquid crystal display device according to the present embodiment, as shown in FIG. 3, the batch-write scan of the polarity inversion signal is executed between the frame periods. Specifically, the period for batch-writing the polarity inversion signal over the entire screen is provided between the sub-frame period for blue display and the sub-frame period for red display in the next frame period.

At this time, as described above, the same polarity is set for all scans in one frame period, and the polarity is reversed only when the polarity inversion signal is batch-written between the frame periods.

Thereby, the same polarity is set for the video signal write scan and reset signal write scan in each of the sub-frame periods for red display, green display and blue display. Therefore, unlike the above-described conventional liquid crystal display device, no luminance gradient occurs in the display image.

The polarity for the video signal write is always the same as the polarity for the immediately preceding reset signal write or for the polarity inversion signal write. For example, the polarity inversion signal write is executed immediately before the video signal write scan in the sub-frame period for red display. At this time, the video signal write and polarity inversion signal write are executed with the same polarity.

Specifically, when the video signal write is performed, there is no need to reverse the polarity from the state of the opposite polarity, and no problem of write time occurs. Further, since the polarity inversion is executed on a frame-by-frame basis, the problem of burn-in of a display image does not occur.

Since the batch-write of the polarity inversion signal is executed with the opposite polarity and at the same time for all the display pixels PX, a predetermined write time is needed, but other scan times (i.e. video signal write scan time and reset signal write scan time) are not shortened by this influence.

For example, in the case of a screen in which the number of gate lines GL is 480, even if the batch-write of the polarity inversion signal is executed in a period corresponding to 10 horizontal cycles (normally, 10 times the signal write time for one row), the time required is only 1/48 of one frame period (about 2% of one frame period).

If the liquid crystal display panel LDP and the backlight BL are driven as described above, there can be provided a liquid crystal display device to which column inversion or frame inversion is applied as the polarity inversion scheme, and which can prevent occurrence of a luminance gradient when a field sequential driving method is adopted.

Therefore, the present embodiment can provide a liquid crystal display device and a driving method thereof, to which column inversion or frame inversion, in particular, frame inversion, is applied as a polarity inversion scheme, and which can prevent occurrence of a luminance gradient in a display image when a field sequential driving method is adopted, thus suppressing degradation in image quality.

Next, a liquid crystal display device according to a second embodiment of the present invention is described with reference to the accompanying drawings. In the description below, the same structural parts as in the liquid crystal display device of the above-described first embodiment are denoted by like reference numerals, and a description thereof is omitted.

Figure 4:
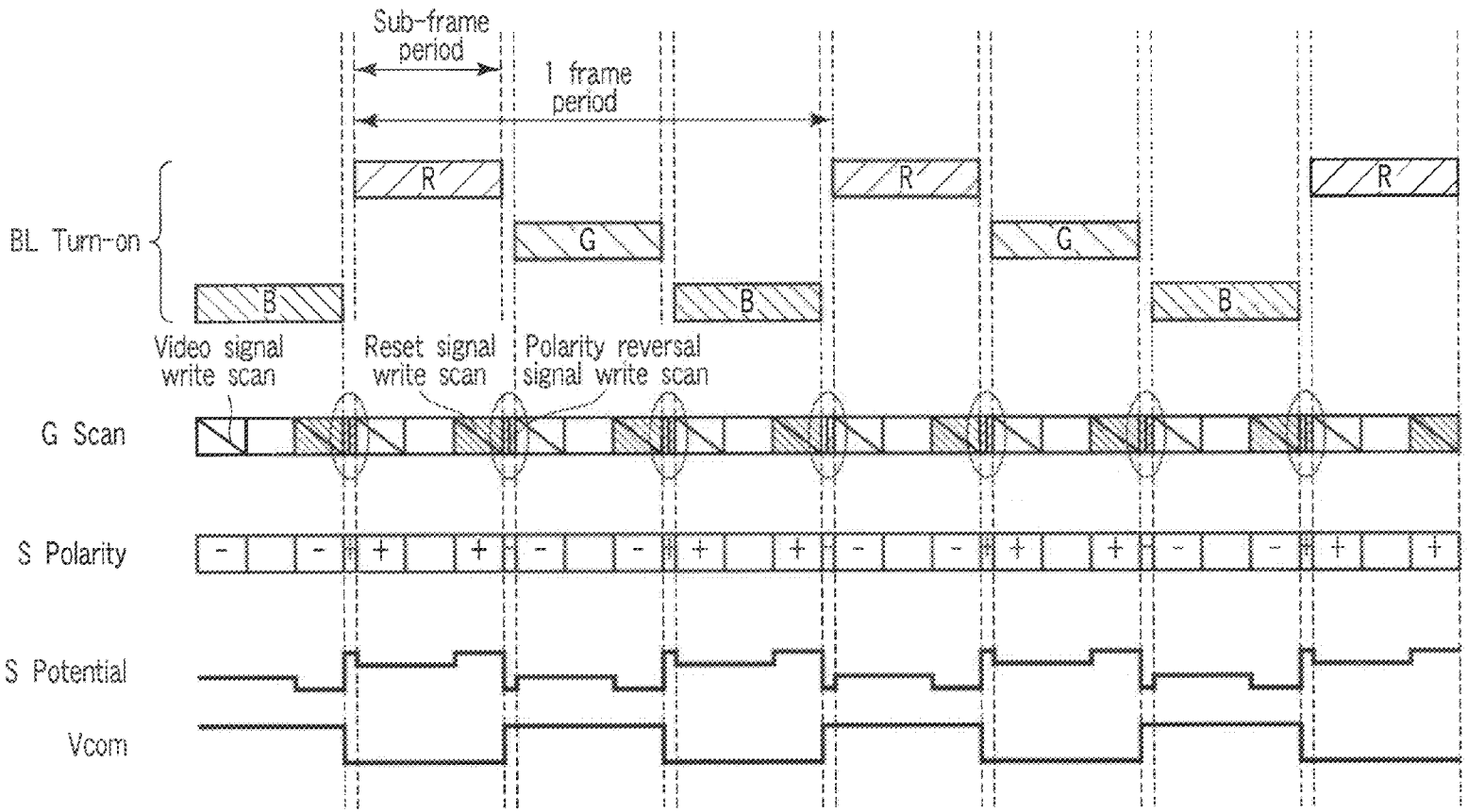
FIG. 4 is a view for explaining another example of a driving method of the liquid crystal display device shown in FIG. 1.

As shown in FIG. 4, in the liquid crystal display device according to this embodiment, the control circuit CNT executes the polarity inversion signal write scan not only between frame periods, but also between sub-frame periods.

The polarities are set, as shown in FIG. 4, such that the polarity for the polarity inversion signal write scan is the same as the polarity for the subsequent video signal write scan and as the polarity for the subsequent reset signal write scan, and the polarity is always reversed by the batch-write of the polarity inversion signal after the reset signal write scan.

In this method, too, the same polarity is set for the video signal write scan and reset signal write scan in each of the sub-frame periods for red display, green display and blue display. Specifically, the present embodiment can provide a liquid crystal display device and a driving method thereof, to which column inversion or frame inversion, in particular, frame inversion, is applied as a polarity inversion scheme, and which can prevent occurrence of a luminance gradient in a display image when a field sequential driving method is adopted, thus suppressing degradation in image quality.

In addition, the polarity of the video signal write scan is always the same as the polarity of the immediately preceding polarity inversion signal write scan. Therefore, with the liquid crystal display device and the driving method thereof according to this embodiment, write deficiency can be prevented when the video signal write is executed.

Besides, the sum of the number of times of batch-write of the polarity inversion signal within one frame period (i.e. the number of times of polarity inversion) and the number of times of polarity inversion between frame periods is an odd number (three). Thus, the polarity inversion is also executed on a frame-by-frame basis.

Specifically, as shown in FIG. 4, in the case where the polarity of signal scan in the first sub-frame period in a certain frame period is set to be positive, the polarity of signal scan in the next sub-frame period is negative and the polarity of signal scan in the last sub-frame period is positive.

On the other hand, the polarity of signal scan in the first sub-frame period in the subsequent frame period is negative, the polarity of signal scan in the next sub-frame period is positive and the polarity of signal scan in the last sub-frame period is negative. Therefore, with the liquid crystal display device and the driving method thereof according to this embodiment, the occurrence of burn-in of a display image can be suppressed.

If the liquid crystal display panel LDP and backlight BL are driven as shown in FIG. 4, the polarity is reversed in every sub-frame. Accordingly, the polarity for red display and blue display is opposite to the polarity for green display in one frame period.

In general, if a counter-electrode potential deviates from a preset center potential of a signal, the absolute value of a voltage, which is applied to the liquid crystal with positive/negative polarity, deviates. As a result, the magnitude (light/dark) of luminance varies from frame to frame, and flicker occurs.

The occurrence of flicker is conspicuous, in particular, in frame inversion. However, if the liquid crystal display panel LDP and backlight BL are driven as shown in FIG. 4, the variation in luminance at the time of red display and blue display is just in opposite phase to the variation in luminance at the time of green display, and the light/dark states are mutually canceled. Therefore, with the liquid crystal display device and the driving method thereof according to this embodiment, the occurrence of flicker can be suppressed.

The present invention is not limited directly to the above-described embodiments. In practice, the structural elements can be modified without departing from the spirit of the invention.

It is not necessary that the batch-write of the polarity inversion signal, which has been described in connection with the first and second embodiments, be the simultaneous write of the black display signal over the entire screen. For example, the scan for successively writing an ordinary black display signal may be executed at high speed, or the screen may be divided into some blocks and the black display signal may be written by slightly displacing the timing from block to block. In a broad sense, these methods are included in the concept of the batch-write of the polarity inversion signal.

As regards the liquid crystal display devices according to the first and second embodiments, the field sequential method using the three colors of red, green and blue has been described. Alternatively, the present invention is also applicable, for example, to a four-color method using red, green, blue and white (W), or a six-color method using red, green, blue, yellow (Y), magenta (M) and cyan (C).

In the liquid crystal display device according to the second embodiment, however, it is necessary that the number of times of batch-write of the polarity inversion signal within one frame period be set at an odd number, thereby to suppress the occurrence of flicker.

In the liquid crystal display devices according to the first and second embodiments, the polarity inversion of the driving voltage is executed, for example, by cyclically reversing the pixel voltage relative to the counter-voltage. Alternatively, the polarity inversion may be executed by varying the counter-voltage. In this case, too, the same advantageous effects as in the first and second embodiments can be obtained.

Various inventions can be made by properly combining the structural elements disclosed in the embodiments. For example, some structural elements may be omitted from all the structural elements disclosed in the embodiments. Furthermore, structural elements in different embodiments may properly be combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device with field sequential driving comprising:

a liquid crystal display panel including a pair of substrates and a liquid crystal layer held between the pair of substrates;

an area light source device which illuminates the liquid crystal display panel;

a driving unit which drives the liquid crystal display panel and the area light source device; and a control unit which controls the driving unit, wherein the liquid crystal display panel includes a plurality of display pixels which are arrayed in a matrix, the area light source device includes plural light sources of different colors which are successively turned on in one frame period, the one frame period includes a plurality of sub-frame periods in which the plural light sources of different colors are turned on, respectively, the control unit includes means for controlling the driving unit in a manner to execute video signal write for writing a video signal in the plurality of display pixels and reset signal write for writing a reset signal in the plurality of display pixels after the video signal write, in a sub-frame period of the plurality of sub-frame periods, and means for controlling the driving unit in a manner to write a voltage signal, corresponding to black display and having a polarity opposite to a polarity of the reset signal in a last sub-frame period in the one frame period, in the plurality of display pixels between the last sub-frame period in the one frame period and a first sub-frame period in a next frame period, and the video signal write and the reset signal write are executed with the same polarity, and a polarity of potential of the plurality of display pixels is reversed between the one frame period and the next frame period.

2. The liquid crystal display device according to claim 1, wherein the control unit further includes means for controlling the driving unit in a manner to batch-write the voltage signal, corresponding to the black display and having the polarity opposite to the polarity of the reset signal in the last sub-frame period in the one frame period, to all the plurality of display pixels.

3. The liquid crystal display device according to claim 1, wherein the one frame period includes the plurality of sub-frame periods, and the polarity of potential of the plurality of display pixels is reversed between the sub-frame periods in the one frame period.

4. The liquid crystal display device according to claim 1, wherein the control unit further includes means for controlling the driving unit in a manner to write the voltage signal, corresponding to the black display and having the polarity opposite to the polarity of the reset signal in the last sub-frame period in the one frame period, in the plurality of display pixels between the sub-frame periods.

5. The liquid crystal display device according to claim 1, wherein the liquid crystal layer includes an Optically Compensated Bend liquid crystal, and the reset signal is a voltage signal corresponding to black display.

6. The liquid crystal display device according to claim 1, wherein the video signal write and the reset signal write are executed with the same polarity in the entire one frame period.

7. A driving method of a liquid crystal display device including a liquid crystal display panel including a pair of substrates and a liquid crystal layer held between the pair of substrates; an area light source device which illuminates the liquid crystal display panel; a driving unit which drives the liquid crystal display panel and the area light source device; and a control unit which controls the driving unit, the liquid crystal display panel including a plurality of display pixels which are arrayed in a matrix, the method comprising:

causing the control unit to successively turn on plural light sources of different colors, which are provided in the area light source device, in one frame period, the one frame period includes a plurality of sub-frame periods in which the plural light sources of different colors are turned on, respectively;

controlling the driving unit to execute, with the same polarity, video signal write for writing a video signal in the plurality of display pixels and reset signal write for writing a reset signal in the plurality of display pixels after the video signal write, in a sub-frame period of the plurality of sub-frame periods, and in a manner to write a voltage signal, corresponding to black display and having a polarity opposite to a polarity of the reset signal in a last sub-frame period in the one frame period, in the plurality of display pixels between the last sub-frame period in the one frame period and a first sub-frame period in a next frame period; and reversing a polarity of potential of the plurality of display pixels between the one frame period and the next frame period.

8. The driving method of a liquid crystal display device, according to claim 7, further comprising:

dividing, by the control unit, the one frame period into the plurality of sub-frame periods; and controlling, by the control unit, the driving unit to reverse the polarity of potential of the plurality of display pixels between the sub-frame periods.

9. A liquid crystal display device with field sequential driving comprising:

a liquid crystal display panel configured to include a pair of substrates and a liquid crystal layer held between the pair of substrates;

an area light source device configured to illuminate the liquid crystal display panel;

a driving unit configured to drive the liquid crystal display panel and the area light source device; and a control unit configured to control the driving unit, wherein the liquid crystal display panel is further configured to include a plurality of display pixels which are arrayed in a matrix, the area light source device is further configured to include plural light sources of different colors which are successively turned on in one frame period, the one frame period includes a plurality of sub-frame periods in which the plural light sources of different colors are turned on, respectively, the control unit is further configured to control the driving unit in a manner to execute video signal write that writes a video signal in the plurality of display pixels and reset signal write that writes a reset signal in the plurality of display pixels after the video signal write, in a sub-frame period of the plurality of sub-frame periods, and further configured to control the driving unit in a manner to write a voltage signal, corresponding to black display and having a polarity opposite to a polarity of the reset signal in a last sub-frame period in the one frame period, in the plurality of display pixels between the last sub-frame period in the one frame period and a first sub-frame period in a next frame period, and the video signal write and the reset signal write are executed with the same polarity, and a polarity of potential of the plurality of display pixels is reversed between the one frame period and the next frame period.

* * * * *